United States Patent [19]

Straka et al.

[11] Patent Number: 5,069,633

[45] Date of Patent: Dec. 3, 1991

[54] PROTECTIVE SHIELD FOR LAMP CONNECTIONS

[75] Inventors: Michael J. Straka, Newburgh; Gino J. Ciancanelli, Bayside, both of N.Y.

[73] Assignee: North American Philips Corporation, New York, N.Y.

[21] Appl. No.: 181,855

[22] Filed: Apr. 15, 1988

[51] Int. Cl.[5] ..... H01R 13/52

[52] U.S. Cl. ..... 439/271; 439/230

[58] Field of Search ..... 439/230, 280, 548, 556, 439/558, 559, 587, 588, 602, 611, 893, 271, 233

[56] References Cited

U.S. PATENT DOCUMENTS

| | | | |
|---|---|---|---|
| 2,774,947 | 12/1956 | Frensch | 439/230 |
| 2,984,812 | 5/1961 | Caferro | 439/230 |
| 3,005,971 | 10/1961 | Lennox | 439/230 |
| 3,181,103 | 4/1965 | Fedorick | 439/230 |
| 3,660,800 | 5/1972 | Detch | 439/280 |
| 4,660,916 | 4/1987 | Williams, Jr. | 439/271 |

FOREIGN PATENT DOCUMENTS

| | | | |
|---|---|---|---|
| 1020733 | 12/1957 | Fed. Rep. of Germany | 439/230 |
| 2644664 | 4/1978 | Fed. Rep. of Germany | 439/230 |
| 1120435 | 10/1984 | U.S.S.R. | 439/230 |

*Primary Examiner*—David L. Pirlot

*Attorney, Agent, or Firm*—Robert J. Kraus

[57] ABSTRACT

A protective shield is provided for preventing moisture from reaching electrical connections of a lamp inserted in a lampholder. The shield includes a waterproof cover part which fits tightly around the end of the lamp envelope and extends beyond the end of the lamp and a waterproof barrier part which prevents moisture from flowing into a junction between the lamp end and a lampholder in which the lamp is inserted. Preferably the cover part and the barrier part are integrally formed from a resilient material, and the barrier part surrounds the end of the lampholder.

4 Claims, 4 Drawing Sheets

PROTECTIVE SHIELD FOR LAMP CONNECTIONS

BACKGROUND OF THE INVENTION

1. Field of the Invention

This invention relates to the adaptation of lamps and associated lampholders for use in damp environments, and in particular to means for protecting such lamps and lampholders against flashover damage.

2. Description of the Prior Art

U.S. Pat. No. 4080030, which is hereby incorporated by reference, describes an arrangement for sealing a space in a lampholder in which electrical terminals of an installed lamp make connection with contacts of the lampholder. The sealing arrangement includes a resilient O-ring which is interference fitted in an undercut groove formed in a face of the lampholder aligned opposite a sealing surface of the lamp. In commercial use this arrangement has been found to have superior sealing reliability with respect to prior art arrangements. Nevertheless, in certain circumstances flashover damage has occurred to the lampholder. Customers have blamed this damage on improper sealing of the space where the lamp terminals make connection with the lampholder contacts.

An analysis of damaged lampholders returned by customers was conducted to determine the cause of the damage. The results of this analysis can best be understood by referring to FIG. 1, which shows a typical lampholder-mounting arrangement used by the customers experiencing the problem. In this mounting arrangement a r fluorescent lampholder having a body 10 of insulating material is mounted in a hole in a horizontally-oriented panel 12 so that a fluorescent lamp can be installed vertically in an outdoor housing such as a lighted business sign.

The lampholder includes electrical contacts 14R, 14L disposed in a space 16 sealed by the resilient O-ring 18. The contacts are secured in the lampholder by respective integrally-formed terminals 20R, 20L which extend through the body 10 into a space 22 for the connection of leads 24R, 24L. The lampholder is secured in the panel 12 by means of metal spring clips 26R, 26L which are attached to the insulating body 10 by respective rivets 28R, 28L. The fluorescent lamp (of which only one end is shown) includes a sealed glass envelope 30 having at each end a concave portion fused around lead-in wires 32R, 32L. These lead-in wires are connected at their upper ends to a filament/electrode 34 and at their lower ends to respective lamp contacts 36R, 36L which are secured in an end insulator 38 of the lamp for making electrical connection with the contacts 14R, 14L of the lampholder. The end insulator 38 is secured in a metal end cap 40 which is affixed to the end of the glass envelope 30 by a cement 42.

The above description and FIG. 1 accurately depict the analyzed lamp-lampholder arrangement in all but two respects. First, the lampholder contacts 14R, 14L and the mating lamp contacts 36R, 36L have been rotated ninety degrees (around longitudinal axis 44) from their actual positions relative to the rivets 28R, 28L. This rotation has been effected to facilitate showing all of the relevant elements in one cross sectional drawing figure, but does not detract from an understanding of the analysis. Second, the means for securing the lamp contacts 36R, 36L in the end insulator 38 is not shown.

There are many different well-known configurations of securing means used by lamp manufacturers; it would be neither fair nor useful to single out one specific configuration as more likely to be involved in the flashover problem under study, without evidence to that effect. Such evidence was not found.

The analysis of damaged lampholders repeatedly showed heavy damage in a concave region delineated by the broken line 45. This damage included total evaporation of the insulating body 10, of the head of rivet 28R, and of O-ring 18 in this concave region. Other damage which occurred repeatedly included blackening of the contacts 14R, 14L and of the rivet 28L. Customers who had examined the damaged lampholders before returning them blamed the damage on the leakage of rainwater or condensate around the O-ring and into the space 16. The customers deduced that water had run across the face of the lampholder body 10 filling the space 16 and recesses containing the heads of the rivets 28R, 28L, thereby forming a conductive path which shorted together the rivet heads and the two contacts 14R, 14L which provide electrical power to the lamp. The destructive capability of such a short circuit is evident in view of the fact that the rivets are electrically connected via the clips 26R, 26L to the panel 12, which typically is made from metal and connected to ground. However, during tests in which applicants subjected undamaged lampholders of the same type to a water spray (with a lamp installed but without the application of electrical power), no leakage by the O-ring was observed.

SUMMARY OF THE INVENTION

It is an object of the invention to eliminate the cause of the above-described flashover damage.

On close examination of the damaged lampholders, it was found that the contacts 14R, 14L were merely blackened, while the head of rivet 28L was slightly burned and the head of rivet 28R was completely burned away. It was also noted that the portion of the insulating body 10 disposed between the contacts was undamaged, while the portion surrounding rivet 28L was slightly scored by flashover lines radiating from the rivet and the heavily-damaged portion delineated by the dashed line 45 was approximately centered on rivet 28R. Apparently this damage was caused by a high current flashover, but from what energy source? The only conductive element in the vicinity of the rivet heads during operation of the lamp is the metal end cap 40, but this cap is electrically insulated from the power leads 32R, 32L in the lamp by the insulator 38.

One possible explanation for the flashover which was considered by the applicants is rainwater flowing down the envelope to the metal end cap 40 after contacting an exposed power lead. This course of events was believed to be too unlikely to occur with the repetitiveness experienced by the customers. lamps having an internal short circuit between the leads 32R,32L and the metal end cap. The lamps which had been used in the damaged lampholders were not available from the customers, but a lamp manufacturer questioned by the applicants reported that the likelihood of such an internal short circuit is remote.

When questioned about the seal formed by the cement 42, the lamp manufacturer stated that the cement is applied to the circumference of the lamp end as an uninterrupted bead, and should prevent the accidental flow of cleaning solutions into the end cap 40 when an overzealous cleaning person wipes the envelope 30 with a wet cloth.

Although there did not appear to be any reasonable explanation for a flashover between the end cap and the rivets, applicants remained convinced that this was the location of the flashover. Several lamps were obtained for the purpose of further study. In an attempt to dissect one of the lamps, it was found surprisingly easy to break free one of the end caps. Close examination of the end cap and the respective lamp end revealed that the bead of cement 42 had discontinuities, and that these discontinuities appeared to be sufficiently large to permit entry into the cap of water droplets which arrive on the cement bead. The other lamps also had such discontinuities. Examination of the cement also revealed that it is porous.

In accordance with the invention, a protective shield is provided for preventing moisture from reaching the electrical connections of the lamp and lampholder. The protective shield includes a waterproof cover part which fits tightly around the end of the lamp envelope and extends over at least a rim of the cap. This should prevent moisture from entering the end cap through any unsealed space between the end cap and the envelope. The protective shield also includes a barrier part for preventing moisture from entering the space in the lampholder where its contacts are located.

In one form of the invention the barrier part comprises an extension of the cover part for surrounding an end of the lampholder which is disposed adjacent the end cap of an installed lamp. By extending the cover part in this way moisture is prevented from entering any gap between facing surfaces of the lampholder and the end cap. Preferably the extension is dimensioned to reach a panel in which the lampholder is mounted, and presses against the panel to form a seal.

Alternatively, the barrier part comprises means such as the O-ring seal described in the afore-mentioned patent, which would then be used in combination with the waterproof cover part.

BRIEF DESCRIPTION OF THE DRAWING

The invention will now be explained with reference to a drawing in which.

DESCRIPTION OF THE PREFERRED EMBODIMENTS

Figure 2:
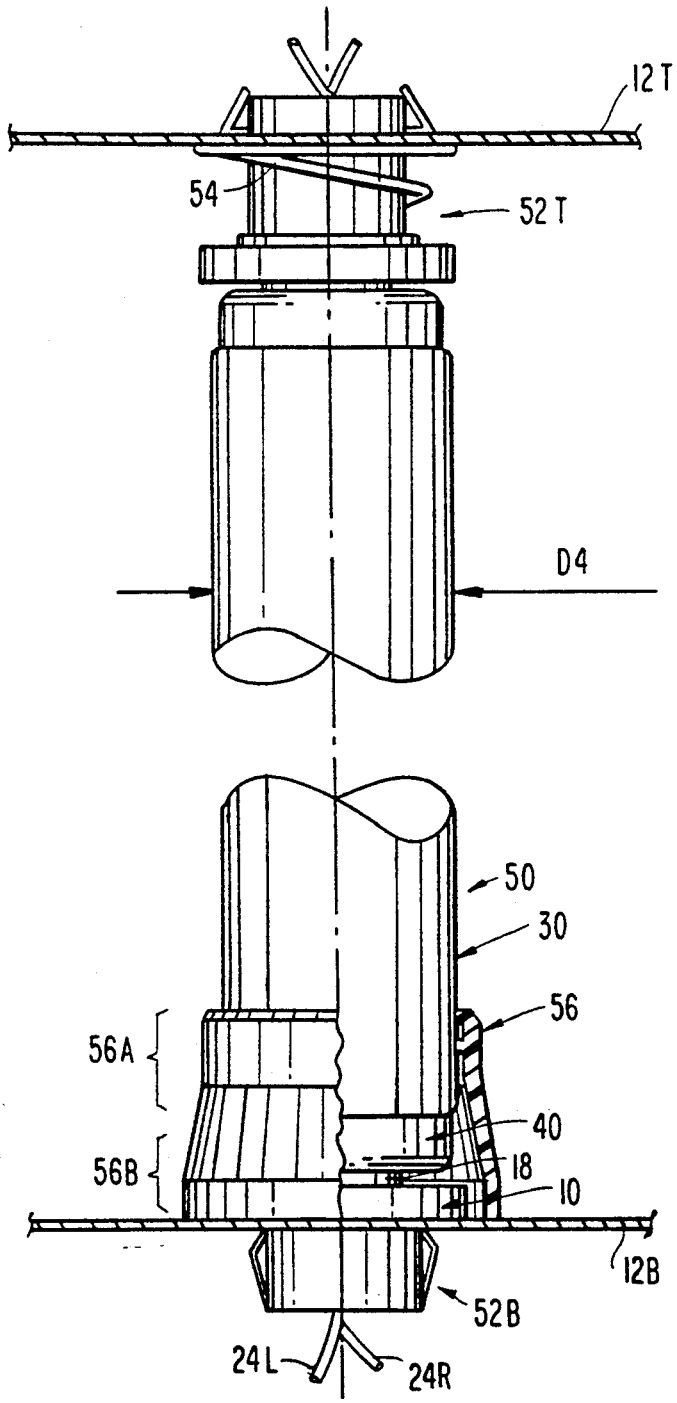
FIG. 2 illustrates an embodiment of a lamp-lampholder arrangement in accordance with the invention.

FIG. 2 shows a preferred form of the invention as applied to a vertically-oriented fluorescent lamp arrangement. This is the orientation with which the customers most frequently experienced flashover damage, and offers the severest test of the effectiveness of the invention.

Figure 1:
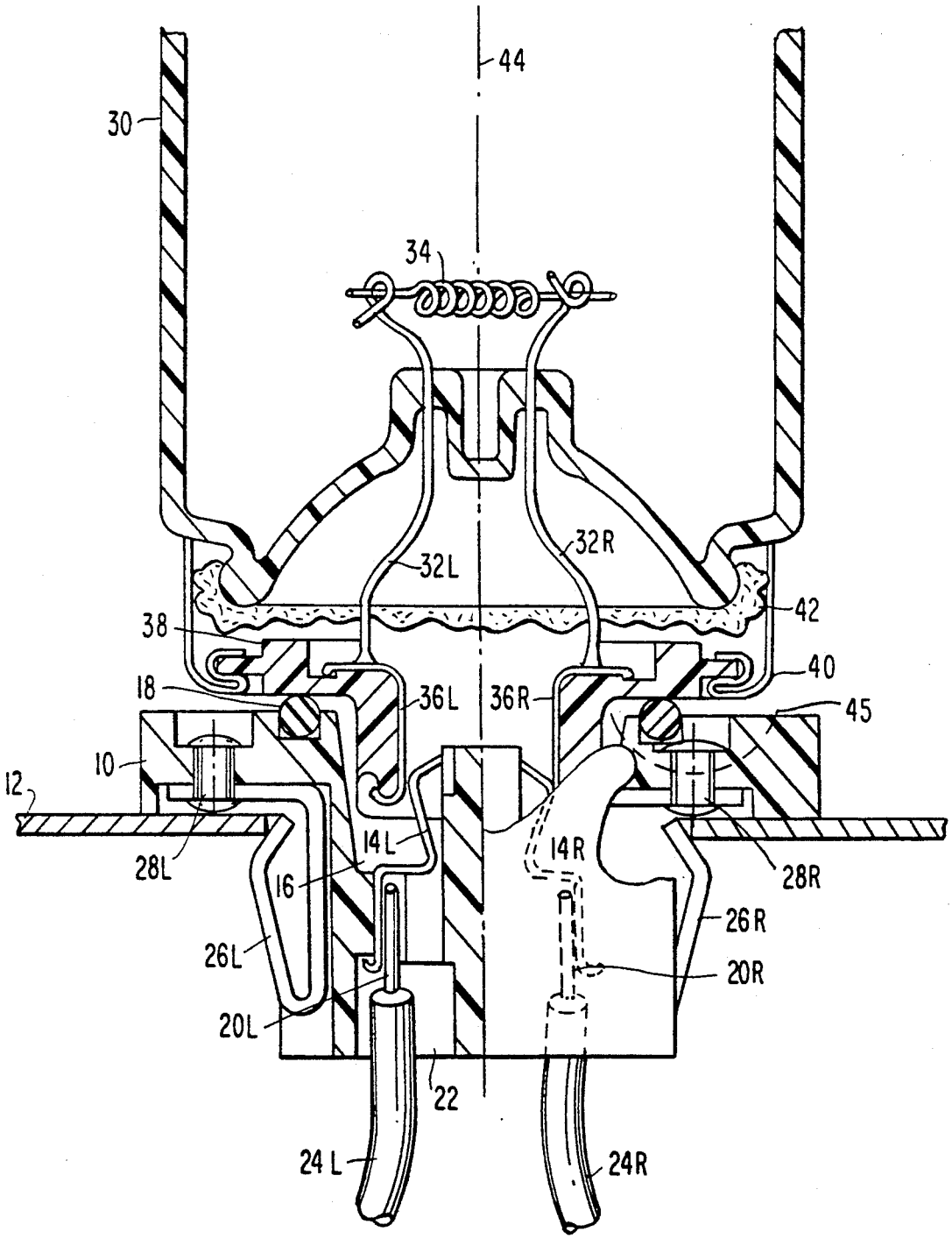
FIG. 1 illustrates the above-described prior art lamp-lampholder arrangement.

In this arrangement a fluorescent lamp 50 (of which only the upper and lower portions are shown) is installed in an outdoor housing (not shown) between a top lampholder 52T, mounted in a top metal panel 12T, and a bottom lampholder 52B, mounted in a bottom metal panel 12B. Preferably each of the lampholders includes sealing means, such as the previously-described O-ring disposed between the face of the lampholder and the adjacent end cap, to provide maximum weatherproofing. Advantageously the top lampholder 52T may also be of the self-aligning type as is described in U.S. Pat. No. 3327281, which is hereby incorporated by reference. Such a lampholder includes means, such as the compression spring 54 shown, to allow limited universal movement of the lampholder. The bottom lampholder 52B is of the type illustrated in detail in FIG. 1.

It is the bottom lampholder 52B which had suffered flashover damage in the customer's lamp housings. To prevent such damage a bell-shaped protective shield 56 molded of a waterproof resilient material such as a rubber compound or a polymeric elastomer is provided. Suitable materials include neoprene and silicone.

The shield includes a cover part 56A fitted tightly around the lamp envelope 30 and extending beyond the upper edge or rim of the end cap 40. This part prevents moisture running down the lamp envelope from entering the cap through any unsealed space between the rim and the envelope. The shield also includes an integral barrier part 56B which entirely surrounds the insulating body 10 of the lampholder and presses against the panel 12B. This barrier part prevents moisture running down the outside of the cover part from entering a gap between the insulating body and the end cap.

Figure 3A:
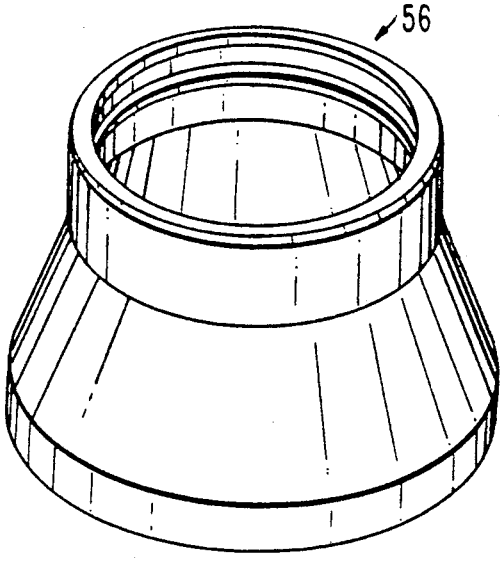
FIGS. 3*a* and 3*b* illustrate an embodiment of a protective shield in accordance with the invention.
Figure 3B:
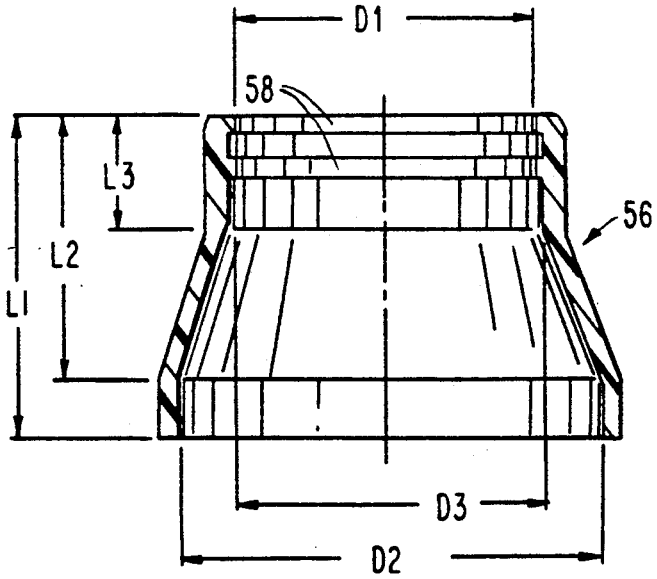

A protective shield which has been made and tested is illustrated in detail in FIGS. 3*a* and 3*b*. The shield was molded of black neoprene with inner peripheral ribs 58 to ensure a good seal around the glass envelope of the lamp. The shield and the envelope of the lamp utilized in the test have the following dimensions, all given in inches:

| | |
|---|---|
| D1 = 1.343 | L1 = 1.37 |
| D2 = 1.87 | L2 = 1.12 |
| D3 = 1.40 | L3 = 1.37 |
| D4 = 1.50 | |

The thickness of the shield (exclusive of the ribs) decreases from; 0.090 inch at the smaller diameter end to 0.060 inch at the larger diameter end.

The test was conducted in a transparent plastic tank containing a grounded metal panel (corresponding to bottom panel 12B) in which two lampholders were mounted. Each of these lampholders is identical to 52B shown at the bottom of FIG. 2. The two lampholders were laterally spaced to receive the opposite ends of a U-shaped fluorescent tube, thereby doubling the opportunity for bottom end flashover damage. The test was conducted twice, once using operating lampholders having respective O-ring seals (KULKA type 582G lampholder available from Dialight Co.), and once using operating lampholders without any seal. The test using the latter lampholder was conducted merely to provide a worst case analysis. Unsealed lampholders are not recommended for outdoor use.

During each test, chlorinated tap water was sprayed on each of the vertical portions of the installed lamp envelope while the lamp was continuously operated for a number of hours. The water was sprayed against opposite sides of each of the vertical portions of the lamp in a sufficient number of streams and at a sufficient flow rate to cause a continuous downward flow of the water around the entire periphery of each portion. The tank included a drain to prevent a rise in water level.

The test utilizing the type 582G lampholder was conducted for about four hours, and the test utilizing the unsealed lampholder was conducted for about six hours. During each test, the voltages applied to the leads of the lampholders were continually cycled between the starting and operating voltages as the lamp was repeatedly started, operated and extinguished.

No flashover whatsoever was experienced during testing.

Figure 4:
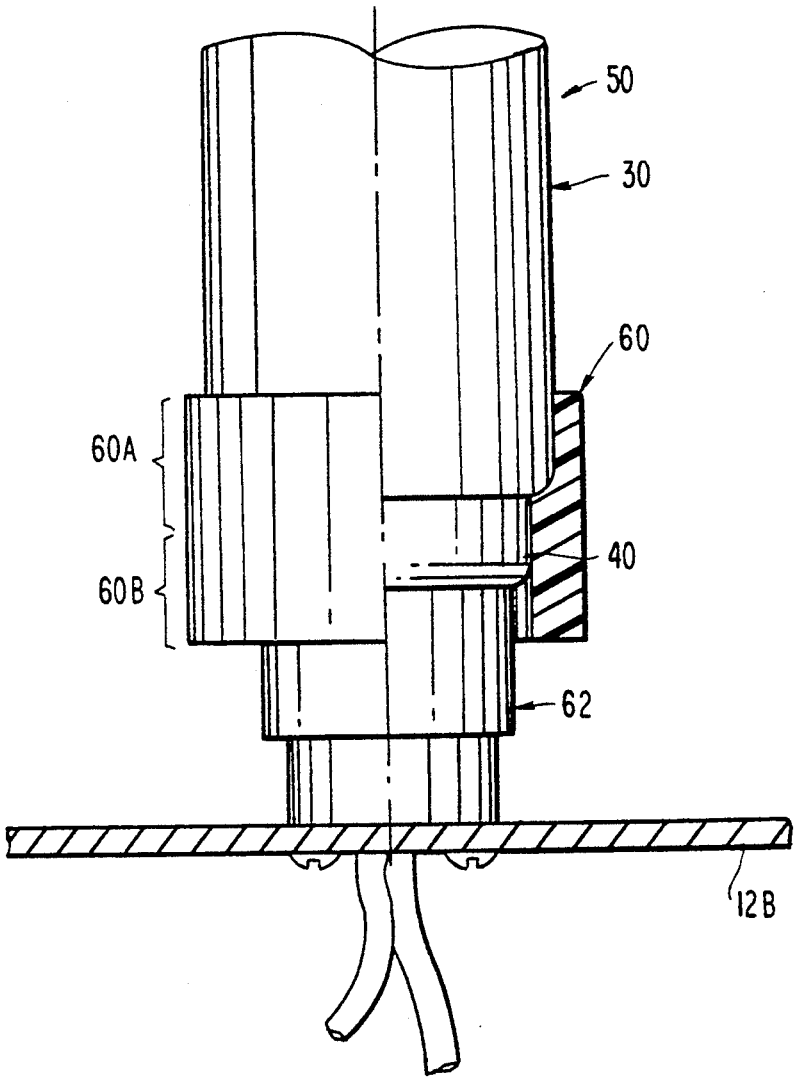
FIG. 4 illustrates another embodiment of a protective shield in accordance with the invention.

FIG. 4 illustrates an alternative embodiment of the protective shield. This shield 60 is also shown as attached to the bottom of a vertically-oriented fluorescent lamp 50 because the greatest potential for water invasion of the end cap occurs here. However it should be noted that the invention is adaptable to either or both ends of a lamp, regardless of how the lamp is oriented and regardless of which embodiment is used.

Shield 60 has a tubular shape and is molded of a waterproof resilient material similar to that of the above-described bell-shaped embodiment. Further, the illustrated tube-shaped shield also includes a cover part 60A fitted tightly around the lamp envelope 30 and extending beyond the upper edge or rim of the end cap 40, and an integral barrier part 60B. However, the cover part has an inner surface which conforms to the shape of and is tightly fitted to the outer surfaces of both the lamp envelope and the end cap, where they meet. The integral barrier part does not reach down to the panel 12B, but merely extends slightly beyond the junction between the lower face of the end cap 40 and the upper face of the lampholder 62 to bar the entry of moisture between these faces.

The protective shield may be provided in a variety of forms which fall within the scope of the invention. For example, the shield may be made of a hard material rather than a resilient material, and the tight fit may be obtained by filling any gaps between the shield and the envelope with a sealant such as a waterproof adhesive. Also, if the lampholder includes a moisture barrier such as an O-ring seal 18, the shield need not extend beyond the upper edge or rim of the cap 40. Rather, the barrier part of the shield would comprise the O-ring seal itself.

It should also be noted that the cover part of the shield performs an additional function, when used with a lamp which emits ultraviolet radiation, either intentionally or through any gaps in luminescent material used in fluorescent-type lamps. Such radiation, if emitted at the end of the lamp, degrades plastic materials commonly used for lampholder bodies. If the cover part is made of an opaque material, it will block such radiation.

We claim:

1. A protective shield for preventing moisture from reaching electrical connections of a lamp inserted in a lampholder, said lamp including an envelope having a cap attached to an end thereof with a rim of the cap surrounding said end, and said electrical connections including electrical contacts in said cap for contacting respective electrical contacts in the lampholder and electrical lamp lead-in conductors contained in the cap which are electrically connected to the contacts in the cap;

characterized in that said shield comprises:

a. a waterproof resilient cover part dimensioned to fit tightly around the end of the envelope and extending over at least the rim of the cap, said cover part preventing moisture from entering the cap through any unsealed space between the rim and the envelope; and b. a waterproof resilient barrier part for preventing moisture from entering a space in the lampholder where the contacts thereof are located, said barrier part comprising an integral extension of the cover part for surrounding an end of the lampholder which is disposed adjacent the cap and dimensioned to reach a panel in which the lampholder is mounted, the extension having a circumference which increases with distance from the cover part to clear the lamp holder and press against the panel for preventing moisture from entering any gap between facing surfaces of the lampholder and the cap.

2. A protective shield as in claim 1 where the cover part is opaque to ultraviolet radiation.

3. An arrangement for preventing moisture from reaching electrical connections of a lamp inserted in a lampholder, said arrangement comprising:

a. a lampholder having electrical contacts for applying electrical power to the lamp;

b. a lamp including an envelope having a cap attached to an end thereof with a rim of the cap surrounding said end, and said electrical connections including electrical contacts in said cap for contacting respective ones of the electrical contacts in the lampholder and electrical lamp lead-in conductors contained in the cap which are electrically connected to the contacts in the cap; and c. a protective shield including (1) a waterproof resilient cover part dimensioned to fit tightly around the end of the envelope and extending over at least the rim of the cap, said cover part preventing moisture from entering the cap through any unsealed space between the rim and the envelope, and (2) a resilient waterproof barrier part of preventing moisture from entering a space in the lampholder where the contacts thereof are located, said barrier part comprising an integral extension of the cover part for surrounding an end of the lampholder which is disposed adjacent the cap and dimensioned to reach a panel in which the lampholder is mounted, the extension having a circumference which increases with distance from the cover part to clear the lamp holder and press against the panel for preventing moisture from entering any gap between facing surfaces of the lampholder and the cap.

4. An arrangement as in claim 3 where the cover part is opaque to ultraviolet radiation.

* * * * *